United States Patent [19]

Yazawa et al.

[11] 4,052,242

[45] Oct. 4, 1977

[54] METHOD FOR PRODUCING A PRODUCT COMPRISING WEFT WEBS OF LARGE WIDTH CONTINUED IN THE WARP DIRECTION

[75] Inventors: Masahide Yazawa; Haruhisa Tani; Masaki Matsumoto; Yasuo Sasaki, all of Tokyo, Japan

[73] Assignees: Polymer Processing Research Institute Ltd., Tokyo; Sekisu Kagaku Kogyo Kabushiki Kaisha, Osaka, both of Japan

[21] Appl. No.: 651,106

[22] Filed: Jan. 21, 1976

[30] Foreign Application Priority Data

Jan. 28, 1975 Japan ..... 50-11653

[51] Int. Cl.[2] ..... B32B 31/00

[52] U.S. Cl. ..... 156/265; 156/519; 28/100

[58] Field of Search ..... 156/176, 177, 181, 264–265, 156/266, 519, 517, 178, 302, 301, 289, 287, 304; 28/1 CL

[56] References Cited

U.S. PATENT DOCUMENTS

| | | | |
|---|---|---|---|
| 3,250,655 | 5/1966 | Adler | 156/265 |
| 3,669,795 | 6/1972 | Yazawa et al. | 156/265 |
| 3,756,893 | 9/1973 | Smith | 28/1 CL |
| 3,765,989 | 10/1973 | Burger | 156/166 |
| 3,859,156 | 1/1975 | Yazawa et al. | 156/265 |

*Primary Examiner*—Charles E. Van Horn
*Assistant Examiner*—Michael W. Ball
*Attorney, Agent, or Firm*—Fred Philpitt

[57] ABSTRACT

A novel product wherein cut webs for wefts (which are abbreviated as weft webs) are successively connected in the warp direction by selvedges adhered onto both the margins of the weft webs, is provided by circulating two right and left heated belts having thereon a hot-melt type adhesive in a tacky state and spaced by the length of each of weft webs of a large width mentioned below; adhering onto each of the belts, selvedge materials which constitute the selvedges of final product and are hereinafter abbreviated merely as selvedges; suddenly dropping the two belts having the selvedges adhered thereonto, on the lower side circulating route of the belts, down onto one of weft webs loaded successively and at a given gap on a conveyer circulating below the belts perpendicularly thereto, over the length corresponding to the width of the weft webs, when both the ends of one of the weft webs and the corresponding belts overlap each other, thereby to adhere both the ends of the weft web onto the corresponding selvedges having said adhesive on their lower surfaces, and just thereafter suddenly elevating the belts thereby to strip and hang up the weft web adhered onto the selvedges from the conveyer; repeating the above-mentioned procedure; and peeling the resulting selvedges having successive weft webs adhered thereonto from the belts to give said novel product.

2 Claims, 2 Drawing Figures

Figure 1:
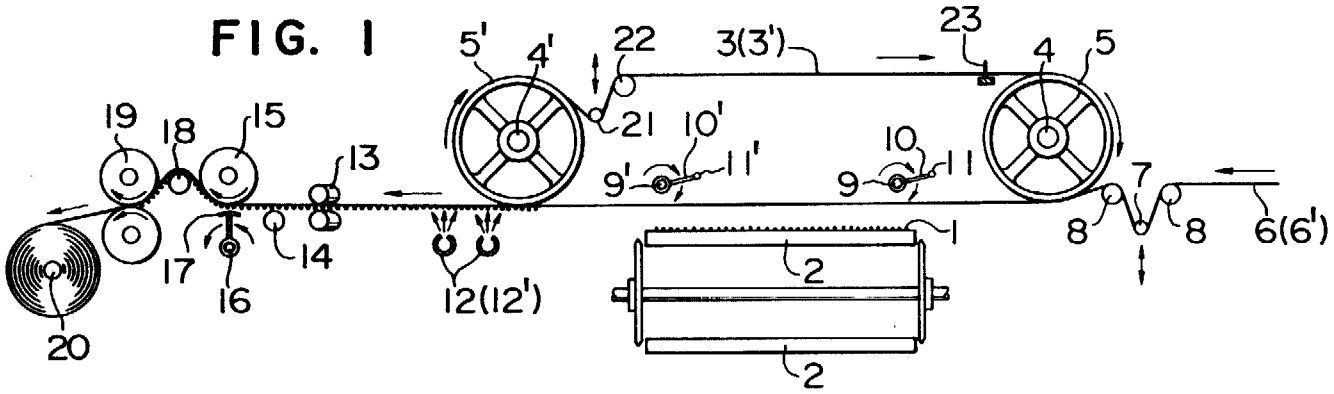

METHOD FOR PRODUCING A PRODUCT COMPRISING WEFT WEBS OF LARGE WIDTH CONTINUED IN THE WARP DIRECTION

DESCRIPTION OF THE INVENTION

The present invention relates to a novel method for producing a novel product comprising cut webs for wefts, of a large width continued in the warp direction. More particularly it relates to a method for producing a product in which cut webs for wefts (which will hereinafter be abbreviated merely as weft webs) successively connected in the warp direction by selvedges adhered onto both the margins of the weft webs, and which is useful for reinforcing in the lateral direction, a web which is generally weak in this direction, such as paper or non-woven fabrics on sale, by lamination; useful for preparing a laminated fabric of warp and weft having a lattice-work structure, merely by placing a warp web onto the novel product in the length direction; useful for preparing a laminated non-woven fabric having a short fiber layer (or a fleece layer) placed between warp and weft; or useful for other purposes.

One of the present inventors previously disclosed in a prior patent application, Japanese patent application laidopen No. 93662/74 (laid-open on Sept. 5, 1974), a process in which weft webs obtained by cutting a web are loaded on a lattice belt on its upper side route and carried to its lower side route, where the weft webs are transferred successively and without any gap, on a warp web or roughly arranged warp yarns running below said lower side route. According to this process, however, since each weft web is placed after flying downwards in the air space by a certain distance although this distance is short, the web is at that time delicately influenced by air resistance, turbulence of environmental air stream, difference in the inertia of weft web accompanying the change in operation speed, etc., whereby the dropping location of the weft web will vary and the peripheral portion of the web will become disordered to a certain extent.

The present inventors have studied a method according to which the above-mentioned drawback can be overcome, and attained the present invention.

The present invention resides in:

A method for producing a product comprising weft webs of a large width continued side by side in the warp direction, which comprises:

horizontally circulating two heated belts in parallel having a hot-melt type adhesive in a tacky state on the outer peripheral surface thereof and spaced by the length of one cut web for wefts, said horizontally circulating belts having upper and lower side routes:

adhering the respective one of right and left selvedge materials which constitute the right and left selvedges of final product, onto the respective one of the lower surfaces of the belts on the lower side circulating route thereof, and running said selvedge materials together with the belts;

successively loading cut webs for wefts obtained by cutting a web of a large width to a given length which corresponds to the distance between the two belts, one by one and at a given gap, onto the surface of a conveyer horizontally circulating below the belts and in the direction perpendicular thereto;

at each time when the front and rear ends of each one of the cut webs for wefts and the corresponding right and left selvedge materials running above the cut webs overlap each other, causing the two belts having the selvedge materials adhered thereonto to suddenly drop over the whole of the length corresponding to the width of the cut webs for wefts, on the lower side route of the belts, down onto the surface of one of the cut webs for wefts loaded on the conveyer, thereby to adhere the front and rear ends of the cut web for wefts onto the corresponding lower surfaces on the selvedge materials having said adhesive thereon, and just thereafter causing the belts having both the selvedge materials and the cut web for wefts adhered thereonto to suddenly rise, whereby the cut web for wefts is stripped from the conveyer, pulled up and transferred by the belts in the warp direction;

repeating the above-mentioned dropping and rising of the belts at each time when the conveyer moves by the length of each one of the cut webs for wefts plus a given gap therebetween;

thereafter stripping the selvedge materials and the cut webs for wefts adhered onto the lower surfaces thereof from the surfaces of the belts;

after the selvedge materials are cooled and the adhesive is solidified;

extending the width of the resulting product thereby to remove the sagging of the cut webs for wefts;

connecting each joint of the successive cut webs for wefts;

and drawing the resulting product afterwards;

to give a novel product of cut webs for wefts continued in the warp direction by selvedges adhered onto both the margins of the cut webs for wefts.

The web of a large width referred to herein is a product in which various fiber materials are arranged in parallel so as to have a large width, such as (1) a stretched film of a large width, a split tape web or split fiber web obtained by partially slitting said film into coherent tape segments of a small width or coherent fibers, having a reticular structure, or a product obtained by extending the foregoing in the width direction; (2) a product obtained by arranging in parallel and plainly a plurality of individual yarns such as filament yarns, spun yarns, monofilaments, flat yarns (or stretched tapes), split yarns, glass fiber yarns, carbon fiber yarns, etc., or a product obtained by connecting said plurality of individual yarns in the lateral direction with a plurality of adhesive filaments just spun; or the like. Further, the warp web referred to herein is a web in which the direction of fiber axis is the same as the longitudinal direction of the web, while the weft web referred to herein is a web in which the direction of fiber axis is mainly towards the lateral direction of the web.

As for the circulating belts to be employed in the present invention, various kinds of belts of 20 - 50 mm width on sale can be used, and particularly when elastomer belts of e.g. polyurethane or the like are employed, a good result can be obtained. As for the means for heating the belts, the belts are always heated on the surfaces of belt-guiding pulleys adjusted to a suitable temperature range by electrical heating or steam-heating, so that the temperature of the belts which are air-cooled during their circulation may be adjusted by reheating by means of hot pulleys, to an almost constant temperature range. If a usual ethylene-vinyl acetate copolymer hot-melt type adhesive is employed, the temperature of the belts is maintained at about 75° - 90° C.

The selvedge materials referred to herein, as seen from the foregoing, are adhered along and onto both the margins of cut webs for wefts in the direction perpendicular to the fiber axis thereof, and constitute two right and left particular selvedges of final product, and hence they are entirely different from selvedges of the web itself conventionally referred to. The selvedge materials will hereinafter be abbreviated merely as selvedges.

For the selvedges, one yarn of a plurality of yarns arranged in parallel, having a width of 15 - 50 mm, which are of same or different kind from the yarns constituting the above-mentioned web, are employed. In case where a plurality of thin yarns arranged in parallel are used for the selvedges, a hot-melt type adhesive, even when it is supplied onto the surface of the circulating belts, is liable to permeate through the clearances of the yarns arranged in parallel and reach the lower surfaces of the selvedges, whereby the front and rear ends of the weft web can be adhered onto the lower surfaces of the selvedges. On the other hand, in case where selvedges of tape form are employed, the adhesive should be applied onto both the surface and backsurface of the tape in advance, and the adhesive is heated on the belts to form a tacky state, so that the tape is adhered onto the belts with the adhesive on the upper side of the tape, while onto the cut ends of the weft web with the adhesive on the lower side of the tape. When yarns are used for the selvedges, if the adhesive is applied onto the selvedges in advance, it may be unnecessary to supply the adhesive onto the belts.

Next, the weft web-carrying conveyer which circulates in the direction perpendicular to the circulating belts will be explained hereunder. When a web for weft webs is continuously supplied and cut to a given length, and the resulting cut webs for wefts are loaded on a conveyer successively and at a given distance, a conveyer of any kind of material or of any shape can be employed so long as the conveyer has a flat circulating surface. If a lattice conveyer as illustrated later in the drawings is employed, the speed of the conveyer is made larger than that of the continuous feed of the weft web, by a calculated value, in order to provide a given distance between the front and rear successive weft webs, and weft webs wetted with water are continuously supplied onto the conveyer at a given speed, whereby the webs are hold by the lattice surface due to the surface tension of water under rub-sliding and hence are under tension. Thus, the web for weft webs is easily cut to a given length when a melt-cutter or the like is dropped down into the clearances between the lattices, and the resulting weft webs are transferred at the speed of the conveyer, successively and in a series while leaving a gap of a given length. At that time, the total length of the conveyer is an integer times the sum of the given length of gap and the length of the web. The shorter the time required for separating each weft web from the surface of the conveyer and hanging up it, the smaller the gap between the front and rear weft webs are made. When the weft web having its ends adhered onto the lower surfaces of the selvedges is pulled up from the conveyer, a stripping force works, and after pulling up, the web has a tendency that the central portion of the web sags downwards due to the weight of the web itself. If an obstacle occurs on account of such phenomenon, adjustment may be carried out by suction from above or by ejected air stream from below. Further, if the width of the selvedges is made suitable and a sufficient adhesion area is applied, the weft web can be hung up without any separation of the ends of the weft web from the selvedges. When the selvedges having the ends of the weft web adhered thereonto are separated from the surfaces of the belts and cooled, the adhesion is fortified as the cooling proceeds. At that time, if the selvedges are guided so that their passages may be slightly extended, thereby to extend the distance between the selvedges, the sagging of the weft web is removed to give an orderly weft web almost same as that arranged on the conveyer. In the present invention, if parallel yarns connected by adhesive filaments in the lateral direction or continuous web such as adhesive-applied reticular split fiber web is used for the weft web, the successive weft webs are connected with adhesive at their joint parts in a manner as shown in the drawings and also as described below. Thus the resulting weft webs form a product continued not only along the selvedges but also over the whole width to made the subsequent operation easier.

As for other methods for connecting weft webs side by side in the warp direction, a plurality of circulating belts are further provided between the above-mentioned two right and left circulating belts in addition thereto, for hanging up weft web from the surface of the conveyer, and the weft web is adhered with a hot-melt type adhesive onto a plurality of yarns provided in advance on said plurality of circulating belts, at the same time when the weft web is adhered onto the selvedges, in a similar manner to that employed for the selvedges, and the yarns are allowed to remain as they are; or said plurality of circulating belts are wetted with an aqueous solution at room temperature and the weft web is attached onto the belts due to the surface tension of the solution and pulled up; or at a location in front of nip rollers provided at the end of the steps of the production method of the present invention where the arrangement of the webs has become orderly after extension of the width of the webs, adhesive-applied yarns are separately additionally adhered onto the resulting product longitudinally, at a pitch of 20 - 300 mm.

When the product obtained according to the present invention is applied to the above-mentioned uses, processing in an on-machine manner, i.e. connected directly to the steps of the present invention, is possible, or processing in an off-machine manner is also possible after the product has been once wound up.

If a web of a large width obtained by connecting parallel yarns in the lateral direction with adhesive filaments according to the invention of the prior patent application of one of the present inventors ("Method for continuously fixing arrangement of yarns," Japanese patent application laid-open No. 83567/75 [laid-open on July 5, 1975]) is employed as the weft web, the pitches between yarns after the extension of the width can be always kept constant. According to the present invention, since the weft web loaded on the upper surface of a conveyer, is, as it is, adhered onto the selvedges dropped suddenly from above and pulled up thereby, disorder of weft web as described above with regard to Japanese patent application laid-open No. 93662/74 does not occur. The present invention has such a specific feature.

Further, if the above-mentioned web obtained according to the invention of said Japanese patent application laid-open No. 83567/75 is used for the weft webs, and such weft webs adhered onto the selvedges are tensioned in the weft direction by extending the width, then there is an advantage that pitches between yarns become constant. The residue of the adhesive filaments is favorable in respect of uniform distribution of adhesive in case where the product obtained according to the present invention is applied to various uses described before. Particularly in the preparation of a product having a short fiber layer (or a fleece layer) placed between the warp and weft webs, since the adhesive filaments of the warp web are directed toward the weft direction while the adhesive filaments of the weft web of the product according to the present invention are directed toward the warp direction, the short fiber layer is fixed in the warp and weft directions by adhesion with the adhesive filaments. Thus a very desirable good result in respect of the quality of product is obtained.

The present invention will be illustrated referring to the accompanying drawings.

Figure 2:
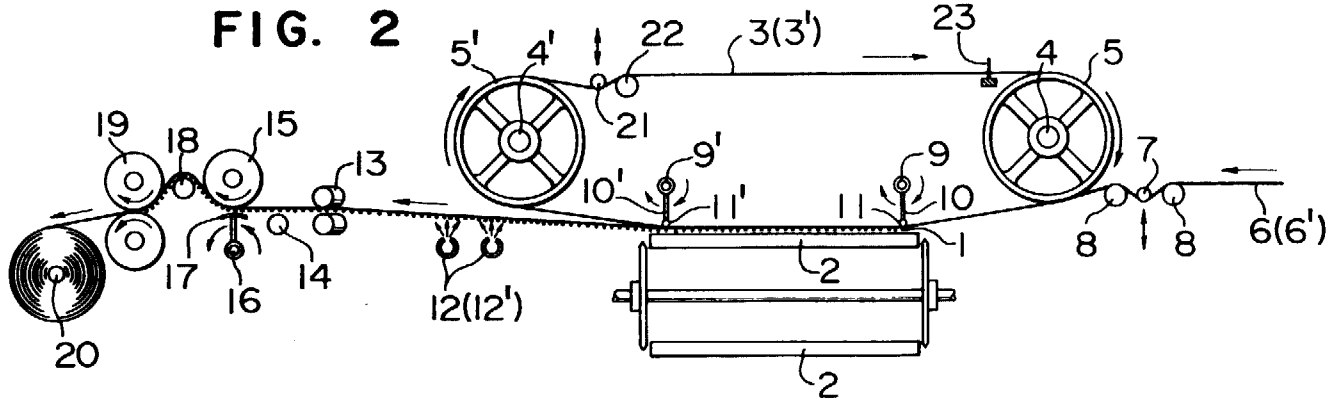

FIG. 1 and FIG. 2 show schematical views of one embodiment of the present invention. FIG. 1 shows a state that the weft web is adhered at the ends thereof onto the selvedges and just pulled up thereby, and then horizontally running, and FIG. 2 shows the instant when the belts having the selvedges adhered thereonto suddenly drop and are pressed down onto the surface of the lattices of the weft web-carrying conveyer.

In FIG. 1, cut weft web 1 is loaded successively and at a given distance on conveyor 2 circulating in the direction perpendicular to the surface of the paper. Above this conveyer, two right and left belts 3, (3') spaced by a distance corresponding to the length of cut web for wefts are circulated in the direction parallel to the surface of the paper. The belts are electrically heated by guiding pulleys 5, 5' to which electricity is fed through slip rings (not shown) attached to shafts 4, 4' thereof. A hot-melt type adhesive is attached onto the outer peripheral surfaces of the belts and heated on the surfaces of the pulleys having their temperature ranges controlled so that the temperature of the adhesive may be within a tacky temperature range. Right and left selvedges 6, (6') are run while being adhered onto the belts on the lower side circulating route of belts 3, (3') via dancing roller 7 and guide rollers 8. When the front and rear ends of cut web for wefts have come just to a location where they and the right and left circulating belts have overlapped each other, belt-pushing rollers 11, 11' attached onto the tips of arms 10, 10' attached onto and rotating around two shafts 9, 9' provided on the inner side of the circulating lower side route of belts 3, 3' and in the direction perpendicular to the belts, push down the belts below the belt-pushing rollers, and as shown in FIG. 2, the lower surfaces of belts just below the respective shafts are contacted with the upper surface of weft web-carrying conveyor 2. With the subsequent rotation of the belt-pushing rollers around shafts 9, 9', respectively, the belts are elevated and the pushing rollers return to the normal circulating route shown in FIG. 1. Then they rotate apart from the belts.

The distance between two shafts 9 and 9' is made to correspond to the width of the weft web.

The weft web-carrying conveyer 2 has a construction that the respective two ends of a plurality of lattices parallel to the direction of width are connected by chains, and the total length of the conveyer is an integer times the length of a section consisting of the number of chain links corresponding to a distance slightly longer than the length of cut web for wefts. If a small amount of water is attached, in advance, onto a web to be cut, a good attachment of the web onto the lattice is effected due to the surface tension of water. On the other hand, the conveyer is circulated at a speed slightly higher than that of the web. Thus, the web on the conveyer is tensioned prior to cutting to take an orderly form, and cutting is surely effected.

Rotating shafts 9, 9' having belt-pushing rollers 11, 11' are interlocked with conveyer. Namely, while the conveyer advances by its one section, the shafts are once rotated, and when belt-pushing rollers 11, 11' are just below shafts 9, 9', respectively, the surface of a lattice in a specified order in each section, brought about to the spot, is pressed by the belts. Since the length of cut web for wefts is made equal to the distance between right and left selvedges as mentioned above, if the belts are suddenly dropped at the instant when the front and rear ends of the weft web have come just below the belts, the front and rear ends of the weft web are pressed by the surfaces of the belts, and the ends of the weft web are adhered onto the selvedges by means of the adhesive in a tacky state. At the next instant, the belts are elevated and cut web for wefts 1 is pulled up while being transferred toward the warp direction. While the belts move by the width of the weft web, the next cut web for wefts 1 is carried between right and left selvedges. By repeating the above-mentioned operations, weft webs are connected on the selvedges 6, (6') in the warp direction without any gap.

If a belt having a suitably large heat capacity is employed, the adhesive does not solidify during the running of the belts in the air space, due to a small reduction in the temperature of the belts, and during that time, the selvedges and the ends of the weft web adhered onto the lower surfaces of the selvedges are stripped from the surfaces of the belts. Thereafter they are passed through cold air-ejected parts 12, (12'), and after sufficient solidification of the adhesion parts, the fiber arrangement of the web is made orderly by way of width-extending means 13 and the resulting product is drawn afterwards. In this case, if the weft web is a product wherein individual yarns are merely arranged in parallel, it is sufficient to leave the weft web as it is. However, if the weft web is such as a web wherein parallel yarns are connected with adhesive filaments in the lateral direction thereof or a split fiber web of a large width having a reticulated structure, then the fibers in the weft web are continued over a certain area thereof and take a mass behavior. Accordingly, overlapping parts in a small width, of the front and rear weft webs or adjacent parts thereof in the warp direction are connected by adhesion with an adhesive to form a product wherein weft webs are continued in the warp direction; otherwise, post-processing will often encounter unfavorable cases.

For effecting the above-mentioned connection, as shown in FIGS. 1 and 2, when the weft webs are passed through width-extending means 13, and then rotating bearing roller for supporting the webs 14 by which the belts are horizontally held from downwards, and their direction is turned on the surface of non-adhesive rubber roller 15, the overlapping parts in a small width or adjacent parts of the front and rear weft webs in the advancing direction are connected by adhesion with adhesive, on the lower surface of the rubber roller 15, in a following manner:

In case where hot-melt type adhesive has already been applied onto the weft webs, the jointing parts are ironed in a linear manner or a dotted line manner or a zigzag manner to adhere them with the resulting semi-molten adhesive, and in this case, if the amount of adhesive attached is insufficient, the adhesion is effected by further supplying an additional amount of adhesive.

As for the means for carrying out the above-mentioned melt-adhesion merely i.e. without supplying an additional amount of adhesive, arched plate of a small width 17 having projections spotted on the surface thereof, which is attached onto the tip of an arm fixed to rotating shaft 16, is provided below roller 15 and rotated under electrical heating or the like heating, and the jointing parts of the weft webs on roller 15 are pressed by the plate 17. Further, rotation of rotating shaft 16 is synchronized with rotating shaft 9 for suddenly dropping belts 3, (3') having selvedges adhered thereonto, and the length of the arm is minutely adjusted so that arched plate of a small width 17 may be contacted with the jointing parts at the same speed as that of the weft webs.

In case where the jointing parts of the weft webs are adhered by supplying an adhesive, the adhesive is applied onto the above-mentioned projections of the arched plate by means of a kiss roller (not shown) or the like, and the adhesive is transferred onto the jointing parts and adhesion is effected.

Weft webs connected in the warp direction and in the whole width on the lower surface of roller 15 are passed through turn roller 18 and then nip rollers 19 and transferred to the subsequent processing step in the width-extending state, or taken up on winding core 20.

When belts 3, (3') are dropped and contacted with the surface of conveyer, the resulting contact points are subjected to an oblique distortion resistance due to the motion in the warp and weft directions. Since the lattice of conveyer to be pushed by dropping of belts in each section is always a fixed one, it is preferable to coat the surface of the lattice to be pushed, with a buffering material, in order to reduce the effect of the above-mentioned oblique distortion resistance.

Further, in order to make the adhesion time as short as possible, a means by which the peripheral speeds of belt-pushing rollers 11, 11' during one evolution thereof are made maximum just below shafts 9, 9' is employed, although the period per one evolution of the pushing rollers is not varied. For such means, a speed-variable mechanism such as eccentric gear, linking mechanisms or the like is provided at the driving parts of the shafts.

Further, in order to absorb the tension-variances of the belts as well as the selvedges at that time, dancing roller 7 and guide roller 8 are provided on the route in the warp direction and also dancing roller 21 and guide roller 22 are provided on the upper side circulating route of the belts.

For driving the belts, if crown pulleys are employed, the track of the belts is fixed. If steam drums are employed in place of pulleys and their surfaces are flat, a guide comb 23 is provided on the track.

EXAMPLE

In a process wherein 250 glass fiber yarns of 600 denier (*d*) were arranged in parallel and so as to have a cylindrical form having a circumference of 1 m and run perpendicularly downwards, a hot-melt type adhesive of an ethylene-vinyl acetate copolymer was ejected into filaments from holes on the outer peripheral surface of a high speed rotating vessel provided at the center of said cylindrical form, and adhered onto the inner side surfaces of said parallel yarns. Thereafter the resulting cylindrical web was cut open at one point on a circle thereof and developed to give a flat web wherein the arrangement of yarns was fixed by adhesive filaments of 2 – 3 mm in pitch and 50 – 70 d, adhered onto the yarns. The flat web, after once wound up, was employed as the raw material for the weft web, which was made to contain water in the unwinding process thereof, followed by squeezing excessive water by means of nip rollers and then supplying onto a lattice conveyer so that the surface onto which the adhesive filaments were adhered might be on the upper side of the web. The total peripheral length of the conveyer consisted of four sections, each having a length of 1,150 mm and carrying thereon a weft web of a cut length of 1,050 mm, each being spaced by an equal distance.

As for the selvedges, 10 glass fiber yarns of 60 d having a hot-melt type adhesive attached thereonto in an amount of 35% by weight based on the weight of the yarns, and arranged in parallel at a pitch of 2 mm, were employed. The adhesive attached onto the selvedges became tacky in contact with the heated belts and functioned so that the belts and the selvedges as well as the selvedges and the ends of the weft web might be adhered together, respectively. For the belts, a polyurethane elastomer belt of 25 mm wide and 5 mm thick was employed. The belt was favorably in the point that the adhesion of the ends thereof could be carried out according to melt-adhesion process, and also an effect of buffering the strains during the process due to its elasticity was expected. Further, due to its warmth-keeping property, heat given by heating on the heated driving pulleys could be maintained almost without dissipating it during its running on the track. Since the distance between the right and left belts as measured from the outer sides thereof was 1,050 mm, one cut web for wefts was adhered onto the right and left belts just from the one outer side to the other thereof.

The above-mentioned hanging up was carried out at a frequency of 30 times/min. Just after the hanging up, the belts had a tendency that they were slightly drawn toward the center therebetween, on account of their self-weights and detachment thereof from the lattice. Thus, belt-pushing rollers 11, 11' shown in FIGS. 1 and 2 were so shaped that the distance between the belts might be slightly extended toward their outer sides during the descending step of the rollers.

The selvedges were detached from the belts and cooled, followed by extending the distance between the selvedges thereby to remove the sagging of the weft webs at the central portion thereof, and subjecting the jointing part of the webs to melt-adhesion on the lower surface of roller 15 shown in FIGS. 1 and 2 to give a continuous product of weft webs having a width of 1,050 mm wherein the weft webs are connected not only by means of the selvedges but also over the whole width in the warp direction.

What is claimed is:

1. A method for producing a product comprising weft webs of a large width continued side-by-side in the warp direction, which comprises:

horizontally circulating two heated belts in parallel having a hot-melt type adhesive in a tacky state on the outer peripheral surfaces thereof and spaced by the length of one of cut webs for wefts, said horizontally circulating belts having upper and lower side routes;

adhering right and left selvedge materials which constitute the right and left selvedges of final product onto the respective sides of the lower surfaces of the belts on the lower side circulating route thereof, and running said selvedge materials together with the belts;

successively loading cut webs for wefts obtained by cutting a web of a large width to a given length which corresponds to the distance between the two belts, one-by-one and at a given gap onto the surface of a conveyer horizontally circulating below the belts and in a direction perpendicular thereto;

at each time when the front and rear ends of each one of the cut webs for wefts come to the position just overlapped with the corresponding right and left selvedge materials running crosswise above the cut weft webs, causing the two belts having the selvedge materials adhered thereon to suddenly drop over the whole of the length corresponding to the width of the cut webs for wefts, on the lower side route of the belts down onto the surface of one of the cut webs for wefts loaded on the conveyer, thereby to adhere the front and rear ends of the cut web for wefts onto the corresponding lower surfaces of the selvedge materials having said adhesive thereon, and thereafter causing the belts having both the selvedge materials and the cut web for wefts adhered thereonto to suddently rise, whereby the cut web for wefts is stripped from the conveyer, pulled up and transferred by the belts in the warp direction;

repeating the above-mentioned dropping and rising of the belts whenever the belts with both the selvedge materials and the cut webs adhered thereon advance by the distance corresponding to the width of the cut weft webs at a speed so controlled that the cut weft webs are picked up one-by-one in a row without leaving any gaps between each other; and thereafter stripping the selvedge materials and the cut webs for wefts adhered onto the lower surfaces thereof from the surfaces of the belts, to thereby give a novel product of cut webs for wefts continued in the warp direction by selvedges adhered onto both the margins of the cut webs for wefts.

2. A method according to claim 1 wherein a plurality of circulating belts are provided between said two belts and said cut web for wefts is adhered with a hot-melt type adhesive onto a plurality of yarns provided in advance on said plurality of circulating belts at the same time that said cut web for wefts is adhered onto said selvedge materials.

* * * * *